US006207017B1

(12) United States Patent
Münch et al.

(10) Patent No.: US 6,207,017 B1
(45) **Date of Patent: *Mar. 27, 2001**

(54) PROCESS AND DEVICE FOR DETERMINING THE EFFECT OF ADJUSTMENT OF FINAL CONTROL ELEMENTS

(75) Inventors: Rudolf Münch, Königsbronn/Zang; Wolfgang Griech; Ulrich Mailänder, both of Heidenheim, all of (DE)

(73) Assignee: Voith Sulzer Papiermaschinen GmbH (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/860,833

(22) PCT Filed: Oct. 25, 1996

(86) PCT No.: PCT/EP96/04639

§ 371 Date: Jul. 10, 1997

§ 102(e) Date: Jul. 10, 1997

(87) PCT Pub. No.: WO97/18349

PCT Pub. Date: May 22, 1997

(30) Foreign Application Priority Data

Nov. 14, 1995 (DE) ..... 195 42 448

(51) Int. Cl.[7] ..... D21F 7/00

(52) U.S. Cl. ..... 162/198; 162/252; 162/262; 162/263; 162/DIG. 10; 162/DIG. 11

(58) Field of Search ..... 162/198, 252, 162/254, 259, 262, 263, DIG. 6, DIG. 10, DIG. 11; 364/471.01, 471.03; 73/159; 200/127, 128, 29

(56) References Cited

U.S. PATENT DOCUMENTS

| | | | | |
|---|---|---|---|---|
| 3,622,448 | * | 11/1971 | Adams | 162/198 |
| 5,400,247 | | 3/1995 | A . | |
| 5,603,806 | * | 2/1997 | Kerttula | 162/198 |
| 5,658,432 | * | 8/1997 | Heaven et al. | 162/198 |

FOREIGN PATENT DOCUMENTS

| | | |
|---|---|---|
| 4238037 | 4/1993 | (DE) . |
| 4239270 | 5/1994 | (DE) . |
| 307076 | 7/1988 | (EP) . |
| 94 12919 | 6/1994 | (WO) . |

* cited by examiner

*Primary Examiner*—Peter Chin
(74) *Attorney, Agent, or Firm*—Ostrolenk, Faber, Gerb & Soffen,LLP

(57) ABSTRACT

A method for determining the effect of an adjustment of actuators used in the manufacture of web of material which are arranged spatially over the width of the web and influence the properties of the web of material, the method being characterized by the fact that, upon the adjustment of one actuator, a prediction as to the effect of the adjustment of the actuator which is derived from detection values on the behavior of the cross section of the property of the web upon the change of actuators is made; that at least one cross section of a property of the web is measured before and after the adjustment of the actuators; that the prediction as to the effect of the actuator adjustments is compared with the measured effect; and that the existing detection values are modified until better agreement is obtained between predicted effect and measured effect.

21 Claims, 4 Drawing Sheets

PROCESS AND DEVICE FOR DETERMINING THE EFFECT OF ADJUSTMENT OF FINAL CONTROL ELEMENTS

BACKGROUND OF THE INVENTION

The present invention relates to a method and a device for determining the effect of the adjustment of actuators used in the manufacture of a web of material, and to a method of producing a web of material.

In the production of webs of material, particularly webs of paper or board, the cross section of the properties of the web of material and the sidewise offset of the web of material must be determined in order to be able, for the establishing of a desired cross section, to adjust certain actuators which are used in the manufacture of the web of material and which, are distributed over the width of the web, and affect the properties of the web of material.

It is known to remove portions of the web of material from the papermaking machine and examine them in the laboratory in order to determine the cross section of given properties of the web. This method is very expensive and has the disadvantage that undesired properties can be noted only very late. These properties can be avoided only much later, so that frequently large parts of webs of material are of defective quality or must be reprocessed as rejects.

In order to determine a transverse-shrinkage profile of a paper web it is furthermore known to apply markings to the web by suitable devices and to detect these markings by suitable devices, for example sensors (DE 40 08 282 A1). The paper machine must therefore be so designed that both the marking device and the suitable detection devices can be introduced into it. Frequently, the construction space necessary for this is not present or cannot be made available for reasons of space. Furthermore, the cost of such a paper machine is increased. The method for the determination of the transverse shrinkage is furthermore very expensive since additional marking means must be employed. Furthermore, marking is undesired since it reduces the quality of the paper.

Finally, in order to determine the local association of actuator positions with measurement positions, it is known to carry out so-called "bump tests" on the web of paper. These are test adjustments of individual actuators which are arranged sufficiently far apart, for the purpose of determining the places and geometrical shape of the effect of these actuators on the properties of the paper as a result of cross section measurements. Such test adjustments are then automatically carried out for example periodically or when desired by the user in order to recognize a change in the behavior of the process. The test adjustments must be so large that the result of the adjustment can be clearly noted in the paper and, after suitable filtration of the measured value, stands out from the process noise and measurement noise. The tests therefore interfere with the production process. During the bump tests and their evaluation it is not possible, of course, to act on the process at the same time by means of said actuators, so as, for instance, to compensate for existing disturbances in the process. Automatic control of the cross section of the properties of the web, if used, must be disconnected during the test. The accuracy with which the places of the effect of the adjusted actuators are determined is determined by the number of cross-section measurement values available, or by the distance between individual data values. This distance is ordinarily 1 cm to 10 cm. In any event, the accuracy obtained is insufficient to determine a precise transverse-shrinkage cross section from the places determined, as shown by the following illustrative calculation:

The places of the setting elements over the width of the production machine are precisely known. Two actuators which are as far apart as possible are adjusted. The distance $x_s$ between these actuators is known. The distance between the changes in section $x_p$ can be measured.

The percentage transverse shrinkage is then:

$$\text{Shrinkage}=((x_s-x_p)/x_s)\cdot 100\%.$$

With a width of the paper web of, for instance, 5000 mm, a typical shrinkage of 5%, or 250 mm, and with a distance between measurement data of 25 mm, a determination of the total shrinkage which is sufficiently accurate is thus possible.

The object of the measurement is, however, to answer, for instance, the question as to at what place on the paper web the shrinkage is minimal, whether it is symmetrical, how the edges of the paper web behave as compared with the middle, etc. The shrinkage must therefore be measured as accurately as possible for the smallest possible regions on the paper web in order to obtain a meaningful transverse-shrinkage cross section.

In order, for instance, to be able to determine the shrinkage in a 500 mm wide region with an absolute precision of 0.5%, an accuracy of measurement in the paper of 500× 0.005 mm=2.5 mm is necessary. With a distance between measurement data of 25 mm, this is not possible by far with simple bump tests.

The object of the invention is therefore to provide a method and a device for determining the effect of an adjustment of actuators as well as a method of manufacturing a web of material which does not have the said disadvantages.

This object is achieved by means of a method which can be referred to, from a control standpoint, broadly, as a "process monitor". The place where the adjustment of an actuator used in the manufacture of the web of material has its effect can be easily determined at any time without requiring the use of special marking devices or additional sensors which detect such markings. The production is not disturbed by test adjustments or by the disconnecting of an automatic cross-section control which may be present. By the iterative procedure and by the simultaneous consideration of many actuator adjustments and corresponding section measurements, a substantially more accurate association of the actuator positions with positions on the web of material is possible so that a meaningful shrinkage curve can be determined.

The mathematical determination of the effect is effected with the use of known values as to the behavior of the properties of the web of material. The mathematical determination of the effect is compared with measured values of a web-property cross section which have been actually obtained—before and after a actuator adjustment—in order to adapt the detection values in such a manner that the results of the calculation agree as closely as possible with the measured results as to the effect.

There is particularly preferred an embodiment of the method in which a prediction as to the place of the effect of the adjustment of the actuator is made. This method is characterized by the fact that it is relatively easy to carry out and can be optimized.

There is furthermore preferred a method which is characterized by the fact that a prediction is made as to the form of the effect, for instance as to the width of the effect at the place of the effect or the amplitude of the change in the properties of the web of material at the place of the effect.

This method also is relatively simple to carry out and has the result that the prediction as to the place of the effect can be excellently optimized.

There is particularly preferred a method in which there are taken into account actuators which are in any event used for the manufacture of the web of material and are required in order to adjust the cross section of the properties of the web of material. Such a method is characterized by the fact that no additional devices or actuators are required which enlarge the construction space of the device for the manufacture of the web of material, increase the cost of construction and production, and possibly also require additional maintenance. Furthermore, the current manufacture of the web of material is not disturbed by an adjustment of the actuator which serves exclusively for purposes of measurement. The current production, therefore, remains unaffected.

There is particularly preferred a method in which the actuators are adjusted only to such an extent as is necessary during production in order to correct process disturbances by an automatic cross-section control. Larger adjustments would disturb the production and reduce the quality of the paper.

There is preferred a method in which the predictions are modified stepwise in the manner that first of all a general statement which is as general as possible with regard to the behavior of the properties of the web of material is made which is characterized in particular by the fact that it can still be made rapidly and with good precision even in the case of poor "signal-to-noise ratio".

One simple statement could, for instance, be the following: The edges of the web of material are displaced by a certain amount as compared with the position which they should have at the measurement point in the machine if there were no shrinkage and no sidewise offset. The two amounts of the adjustment are to be determined.

A first refinement of this statement would, for instance, be as follows: The transverse shrinkage is greater at the edges than in the middle and the transverse-shrinkage cross section resulting therefrom has a key-shaped contour the amplitude of which is to be determined.

It is therefore seen that by this method auxiliary devices for measuring the position of the edge-section devices and of the paper edges can be dispensed with.

Furthermore, a method is preferred in which the prediction as to the properties of the web of material comprises as accurate as possible a determination of the transverse-shrinkage behavior.

Finally, there is particularly preferred a method in which an averaging of the results in connection with the determination of the transverse-shrinkage cross section is carried out for a number of predictions and also for a number of actuator adjustments. Such an averaging has the result that the error upon the mathematical determination of the effect is reduced to a minimum.

The object indicated above is achieved by a device which has the at least one measuring device for detecting the cross section of a property of the web and an arithmetic unit. Due to the fact that the arithmetic unit processes predictions or detection values as to the behavior of the properties of the web of material upon the adjustment of an actuator and on basis of these detection values arithmetically determines the effect by means of a rule of association, it is possible, at any time, to predict on-line the place which is to be associated with the change of an actuator and to determine an exact cross section of a property of a web of material and/or determine a sidewise offset of the web.

The said object is finally achieved by a method of manufacturing a web of material from a water-pulp slurry in which at least one cross section property of the web is measured; and a plurality of actuators arranged spatially over the width of the web and influencing at least one of the properties of the web are adjusted in accordance with the measured values in such a manner that a desired cross section of a property of the web is established.

BRIEF DESCRIPTION OF THE DRAWINGS

Other features and advantages of the present invention will become apparent from the following description of the invention which refers to the accompanying drawings.

The invention will be explained in further detail below, with reference to the drawing, in which.

DETAILED DESCRIPTION OF THE PREFERRED EMBODIMENT(S)

In the case of the web of material, different properties of the web of material can be detected, for instance the basis weight, the moisture content, the transverse shrinkage, the fiber position, the roughness, the strength, the elasticity, the opacity, the smoothness, the content of filler, the thickness, and the formation. The measurement values determined over the width of the web are referred to as cross section.

It is assumed that, for the production of the web of material via a headbox, a water-fiber slurry, which possibly also contains fillers, is introduced into a wire section (former) and that the fiber web—for instance paper web—formed there is fed via a press section to the drier section. The headbox can be so developed that actuators are provided to control the properties of the material. For instance, a so-called secondary pulp stream which consists, for instance, of dilution water or of a second type of paper pulp but with a different, preferably lower, pulp density can be fed to the water-fiber slurry. The transverse distribution in the headbox is adjusted by a plurality of sectional feed lines each of which has a control valve, referred to as an actuator. Mixing valves, again referred to as actuators, can be provided at the place where the water-fiber slurry is brought together with the secondary stream of pulp. Actuators of the type referred to here can also be provided at other places of the paper machine, for instance in a steam blow box in the press or drier section or else in an after-treatment device, for instance in a coating machine.

Figure 1:
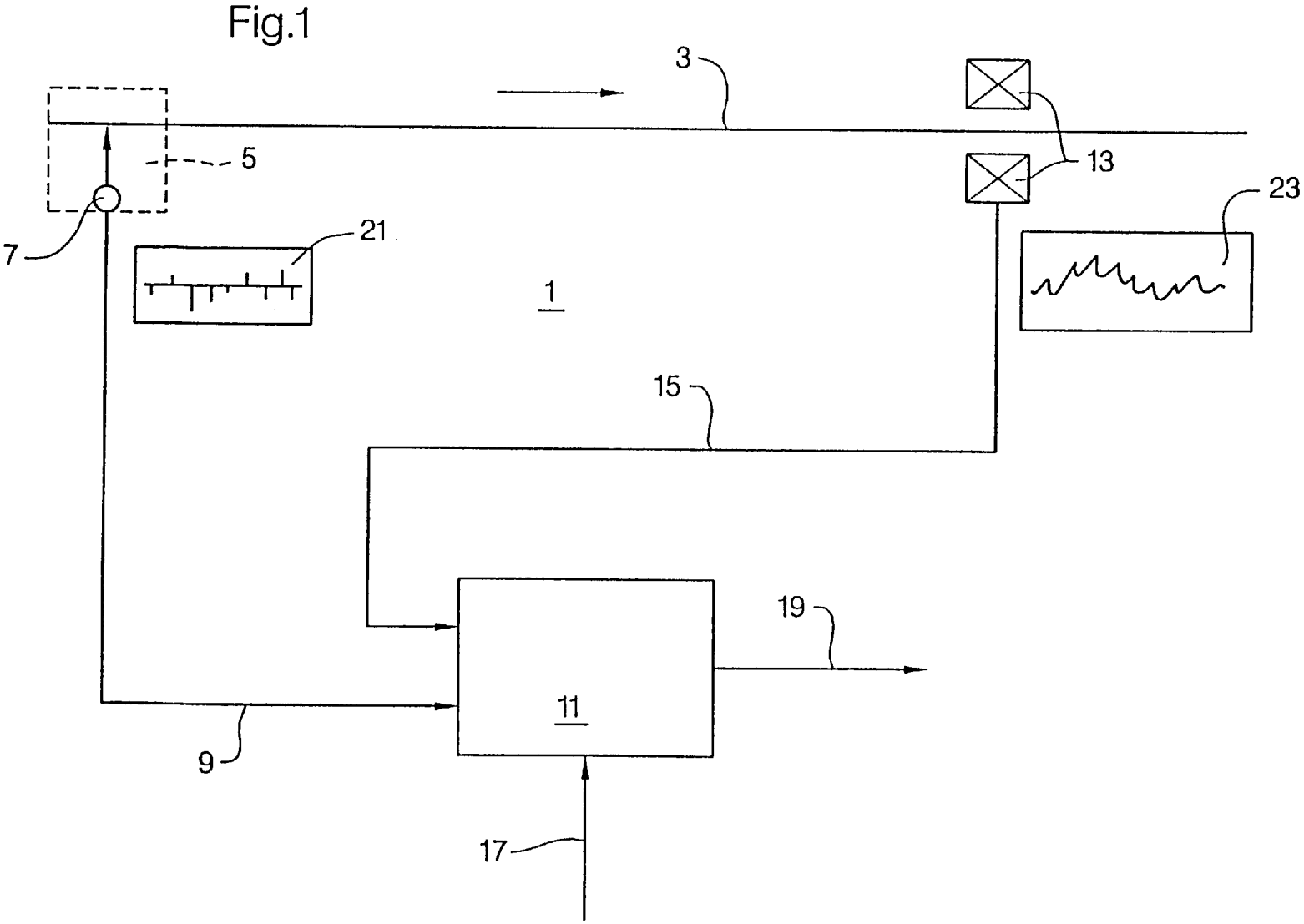
FIG. 1 is a diagrammatic block diagram of a device for determining the effect of actuator adjustment.

FIG. 1 shows a device 1 for determining the effect of actuator adjustments, which serves here, in addition, in order to determine a transverse-shrinkage cross-section for detecting the sidewise course of the web. The web of material 3 is conducted from left to right as shown in FIG. 1, as indicated by an arrow. To the left in FIG. 1 there is shown in dashed line a headbox 5 which has numerous actuators 7 distributed transversely over the web of material 3, only one of which actuators is shown here. The others lie outside the plane of FIG. 1. The actuators 7 are connected by a control line 9 to an arithmetic unit 11. At a distance from the headbox 5, a measuring device 13 for determining cross sections of the properties of the web is located at some point of the apparatus for the production of the web of material 3. This device can, for instance, be arranged at the end of a papermaking machine on the other side of the drier section. However, it is also possible to provide several such measuring devices within the papermaking machine.

The measuring device 13 is connected by a measurement line 15 with the arithmetic unit 11. Via an input line 17 additional information—discussed in further detail below—concerning the cross section of the web of material 3 can be introduced into the arithmetic unit 11. The calculation results of the arithmetic unit 11 are fed onto an output line 19.

In FIG. 1, there is shown a diagrammatic bar graph 21 on basis of which it is intended to indicate that the different actuators 7 distributed transversely over the web of material 3 have different adjustments.

Alongside the measuring device 13 there is shown diagrammatically a graph 23 which represents a measurement signal detected by the measuring device. Corresponding to the different adjustments of the actuators 7 and other process parameters, different measurement signals with regard to the width of the web result. By the zig-zag line it is indicated that measurement noise and process disturbances are superimposed in large amount on the measurement signal.

The relationship between the adjustment of different actuators 7 and the measurement signal in graph 23 will be explained in Further detail.

Figure 2:
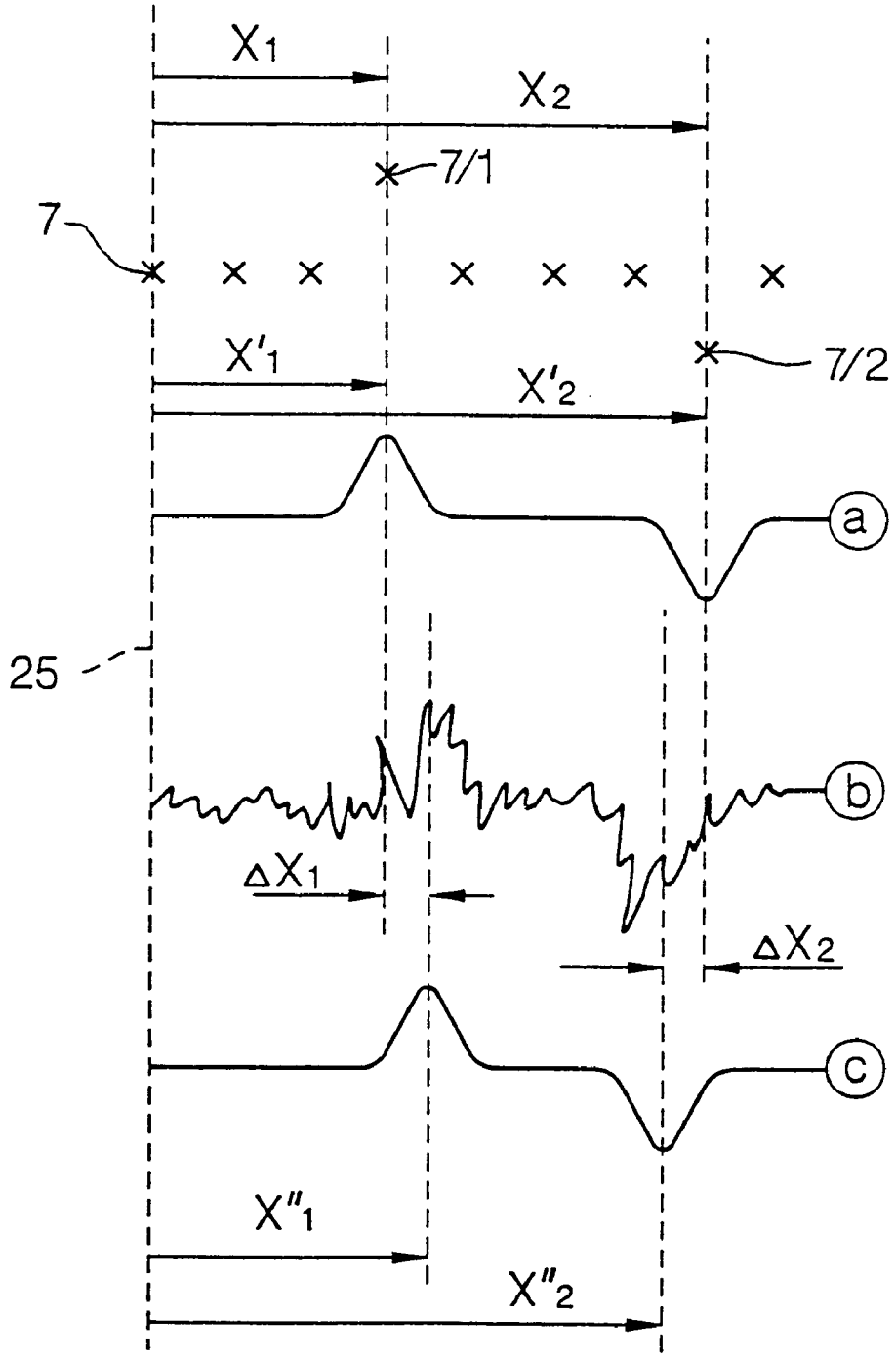
FIG. 2 is a diagram which serves to explain the method for determining a cross section.

For this purpose, several graphs are shown one above the other in FIG. 2. In the uppermost graph, the distance x of an actuator 7 from an imaginary line 25 lying, for instance, outside the paper web and extending along the papermaking machine is indicated, it being shown here in dashed line. In the second diagram from above which follows it, there are shown a number of actuators, indicated by crosses. One actuator 7/1 is present, for instance, at a distance $x_1$ from the reference line 25 and has here a "positive" setting, with a corresponding "width effect". Another actuator 7/2 is at a distance $x_2$ from the reference line 25. Here, one starts purely as example from a "negative" setting with a corresponding "width effect" of this actuator. By "width effect" there is understood here the width of the effect of the adjustment of the actuator at the place of the effect.

Below the second graph, in which the individual actuators are indicated by crosses, the expected reaction in the cross section of the web of material 3 or the predicted effect is shown in the third curve, designated curve a. As a result of the "positive" settings of the actuator 7/1. a locally increased moisture content or a locally greater thickness of material leading to a locally increased basis weight could be established in the cross section, depending on what property of the web the actuator influences. In corresponding manner, as a result of the "negative" setting of the actuator 7/2, a reduced moisture content or reduced thickness of material would be established at a place which is associated with this second actuator. In curve a, within a first prediction based on detected values or first hypothesis, it is assumed that the places $x'_1$ and $x'_2$ corresponding to the setting of the actuators 7/1 and 7/2 or positions of the answers or effects in the web of material or paper web correspond precisely to the actuator positions $x_1$ and $x_2$. The expected answer positions or places of effect therefore lie at the distance $x'_1$ and $x'_2$ respectively from the reference line 25. This is indicated here by arrows.

By a change in the actuators 7/1 and 7/2 which, in accordance with the first curve, are located at the positions $x_1$ and $x_2$, there is obtained a change in the cross section detected by the measuring device 13 shown in FIG. 1 which is reproduced in curve b and which was shown in FIG. 1 in curve 23, It is also indicated in FIG. 2 that the measurement signal corresponding to the cross section has measurement noise and process disturbances superimposed on it. A local increase in the cross section which is due to an adjustment of the actuator 7/1 can be noted, as well as a local reduction in the cross section, which is based on a change in the actuator 7/2. It is clear, however, that as a result, for instance, of a transverse shrinkage which took place upon the drying of the web or of a sidewise course of the web, the reaction in the cross section is shifted with respect to the reference line 25—once to the right and once to the left. The adjustment of the reaction is indicated here by $\Delta x_1$ and $\Delta x_2$.

It is seen that the prediction reproduced in curve a, namely that the reaction in the cross section and therefore the place of the effect corresponds precisely to the actuator positions is not entirely accurate. Therefore, several further predictions based on modified detected values with regard to the expected effect in the cross section are made. The best prediction is reproduced in curve c. It is seen that the answer to the actuator 7/1 takes place approximately at the place $x''_1$ and that the answer to the adjustment of the actuator 7/2 takes place approximately at the place $x''_2$. The basic detection values have been so optimized that the agreement between the measurement signal in curve b and the place calculated on the basis of the prediction in accordance with curve c is optimal. Additional detection values or detection values which led to the first prediction a can be inputted into the computer 11 for instance via the line 15 shown in FIG. 1. However, the computer can also generate the detection values completely automatically and calculate therefrom predictions with respect to the effects. For the initial detection values and for the rules for adapting the detection values, a priori detections be used or entered in the computer.

It is possible that the detection values with regard to the places of the effect of actuator adjustment are based initially only on the following simple statements:

There is a sidewise course of the web the amplitude of which is to be determined.

There is a transverse shrinkage of the web during the papermaking process which is initially assumed to be of the same size (in per cent) at all places of the web and the size of which is to be determined.

The detection values can be refined stepwise in an advanced method step by, for instance, the following statements:

The transverse shrinkage is greater at the edges than in the center and the resultant transverse-shrinkage cross section has a key-shaped contour the amplitude of which is to be determined.

The transverse shrinkage on the one half of the machine is greater than on the other half. The amount of the factor of asymmetry is to be determined.

From FIG. 2 therefore, the basic principle of the method in question here for the determination of a transverse-shrinkage cross section becomes clear. First of all, therefore, upon an adjustment of an actuator, in this case the actuator 7/1 or 7/2, on the basis of a first prediction, the expected reaction in the cross section is calculated (see curve a). In curve a, for example, the prediction is made that the position of the answers in the cross section takes place precisely at the places which also correspond to the actuator positions. It is found that, here, there is a difference between the calculated value of curve a and the actual measured value of curve b which is caused by the transverse shrinkage or sidewise course of the web.

Therefore, the detection values or the prediction are modified and the expected reaction newly calculated. The calculation, which is effected with the use of the best prediction, is reproduced in curve c. The prediction present here proceeds from the fact that the answer to the adjustment of the actuator 7/1 takes place at the place $x''_1$ and that the answer to the actuator 7/2 takes place at the place $x''_2$. In this connection, one starts from the relationship $x''=x'+\Delta x$. It is found that, with the prediction c selected here, the difference between the measurement signal shown in curve b and the calculated signal of curve c is very slight.

One way to arrive at curve c which corresponds to this prediction would be to test many hypotheses with regard to the places $x''_1$ and $x''_2$ which differ only slightly and to select the hypothesis having the best agreement with the measured signal shown in curve b.

One refinement of the manner of procedure is to allow a priori knowledge with regard, for instance to the shrinkage behavior and the course of the web to be included in the calculation of the hypotheses. In this way, the number of hypotheses to be examined can be considerably reduced.

From what has been stated with regard to FIG. 2, the following results: If a difference for instance of the local basis weight from a required amount is determined at the place $x''_1$, then the amount of the adjustment resulting from the difference must be fed to that actuator 7 which is at the distance $x_1=x''_1-\Delta x_1$ from the reference line 25. It is therefore possible, in simple manner, to associate a local property of the web of material with an actuator and thus take into account a transverse shrinkage or else a sidewise course of the web.

It is obvious that the method described is also suitable for an on-line determination of a sidewise course of the web of material.

The method of correlation calculus has proven a particularly suitable method of calculation for calculating the degree of agreement between curves b and c. Another measure would be the mean-square deviation of the two curves.

Preferably, in the method described here, there are taken into account only those actuators which are required for the ordinary current setting of the cross section. Thus, there can be concerned, for instance, actuators which affect the headbox. Therefore, as actuator there can be used a control valve or a mixing valve in the feed lines of the headbox. However, it is also conceivable to use as actuators devices which can, for example, influence the heating power of the drier section in separate regions differently over the width of the web. The method described here or the device for determining the effect of an adjustment of an actuator can be set in all cases in the same manner. In accordance with what has been stated here, therefore, there can also be used actuators which influence the basis weight, the moisture content, the density, or some other property of the web of material or paper.

For the selection of the predictions or hypotheses for the determination of the different curves in FIG. 2 one preferably proceeds stepwise. First of all, a prediction is made in which, on the one hand, only a few values are to be determined and, on the other hand, a very large number of setting values and cross-section measuring values are available. This applies, for instance, to a prediction with regard to the total transverse shrinkage of the paper web and the place—measured transversely to the web of paper—in the cross section at which the change in an actuator appears. By taking such a prediction into account, a dependable determination of the place can be effected very rapidly even if the setting values are very small as compared with the process noise.

In the case of a further prediction, a somewhat more exact determination of the shrinkage behavior can be made. Example: Assume that in a production machine there are 150 measured cross section data values as compared with 50 cross-section actuators. Upon each action of a cross-section control, all actuators are normally adjusted by a small amount in order to compensate for the process disturbances. After the adjustment and after the comparison of the cross sections before and after the adjustment there are therefore available 150+50 items of information which can be evaluated. If, for instance, only one prediction with regard to the total shrinkage and with regard to the amount of the amount of the sidewise course of the web is to be made, only two information items or two numerical values out of the 200 information items available are to be determined. This is still readily possible even in the event of very large process noise and measurement noise. The more predictions which must be made, for example in addition with regard to the width of the process answer to an actuator adjustment the more unfavorable the signal-to-noise ratio will be, so that the information items or numerical values which are determined will also contain an error.

In order to be able to calculate a transverse-shrinkage cross section which is as accurate as possible, after each adjustment of an actuator 7, the transverse-shrinkage cross section is preferably determined by means of the arithmetic unit 11 in the manner that a comparison of the predicted effect with the effect actually measured is made and the detection values are modified on the basis of the differences until a better agreement or an agreement which is as good as possible between the predicted and calculated effects is obtained.

In order further to increase the accuracy of the method, special methods for the treatment of the cross-section measurements before and after the adjustment are possible. Current methods would, for instance, be the use of filter algorithms in order to reduce the proportion of noise. If a statement can be made as to the variation with time of the noise or static properties, for instance with the use of measured variables which cause the noise or which are produced alongside of it, it is possible subsequently to free the measured cross section in part again from the known part of the noise or to adapt the filters optimally to this.

Local transformations and weightings of the measured cross sections for the purpose of damping those portions of the measured profile which are less profitable for the determination of the effect of the actuators are also promising.

In order to be able to reduce to a minimum the errors due to measurement noise and process disturbances, the calculated results $x''_n$, as shown for example in curves a and c in FIG. 2, are determined with due consideration of a large number of actuator adjustments. Due to the fact that a number of predictions and also a large number of actuator adjustments are taken into account, it is possible very substantially to eliminate the measurement errors, even if the amplitude of the actuator adjustments is very small.

In line with the proposed gradation it is meaningful to use in each case only as many setting processes following each other in time as are necessary in order to obtain sufficient precision for the desired statements.

For example, only a few, if any, averagings are necessary for the determination of the total shrinkage. The total shrinkage is therefore determined very accurately with a few adjustments of all actuators. A finer resolution of the transverse-shrinkage cross section requires accordingly more information from more adjustments. The determination therefore takes correspondingly longer.

Instead of averagings such as have been proposed here, more complex filter or estimate algorithms can, of course, also be used.

The apparatus shown in FIG. 1 has only one measuring device 13. However, it is also possible to arrange several measurement places within a manufacturing apparatus or papermaking machine, they being located one behind the other, as seen in the direction of conveyance of the web of material. The transverse-shrinkage cross section can then be calculated at several places within the machine so that conclusions can be reached therefrom as to how the transverse shrinkage has changed between different measurement points.

Another use of the invention consists in observing the influence on the transverse shrinkage on-line of a special treatment of the web of material in a suitable after-treatment device, for instance the sizing or after-moistening of a web of paper. From the change in shrinkage, further process values can then be derived, for instance, the absorption of size by the paper. These process values can then be used for the determination of further settings.

From the description of FIGS. 1 and 2, it can readily be seen that great advantages are obtained by the method for the determining of a transverse-shrinkage cross section of a property of the web of material upon the manufacture of a fiber web from a water-fiber slurry: It is readily possible to detect different properties at different points of a papermaking machine over the width of a web of material and to act specifically on certain actuators of the papermaking machine in order, in specific manner, to influence the properties of the web of material. In this way, cross sections for the basis weight, the moisture content, the transverse shrinkage and/or the thickness of the web can be set and controlled accurately; for example, the transverse-shrinkage cross section can even be changed in targeted manner by local wetting of the web.

Other factors of influence on the shrinkage which could be adjusted in targeted manner are, for instance, production process parameters in the region of the wet section, the press, and drier section. As examples, mention may be made here of local temperature distribution of the web of paper during the drying process, the moisture cross section within the drying process or directly behind the press, the fiber orientation, locally different strong inhibition of the shrinkage process by a suitable differently strong fixing of the web in the transverse direction of the web. Further factors of influence are conceivable. What factors of influence are useful in practice will become automatically evident after longer use of the method proposed for the on-line measurement of the transverse-shrinkage cross section.

In modern papermaking machines, the actuators, particularly the control valves for the setting of the specific basis weight are provided in large number very close to each other. It is therefore extremely important to be able to predict precisely what actuator must be addressed in order to influence a local property of the web of material. Specifically this is readily possible with the method described here and in the apparatus shown in detail.

Possible uses of the invention will be explained in further detail below with reference to FIGS. 3 and 4.

Figure 3:
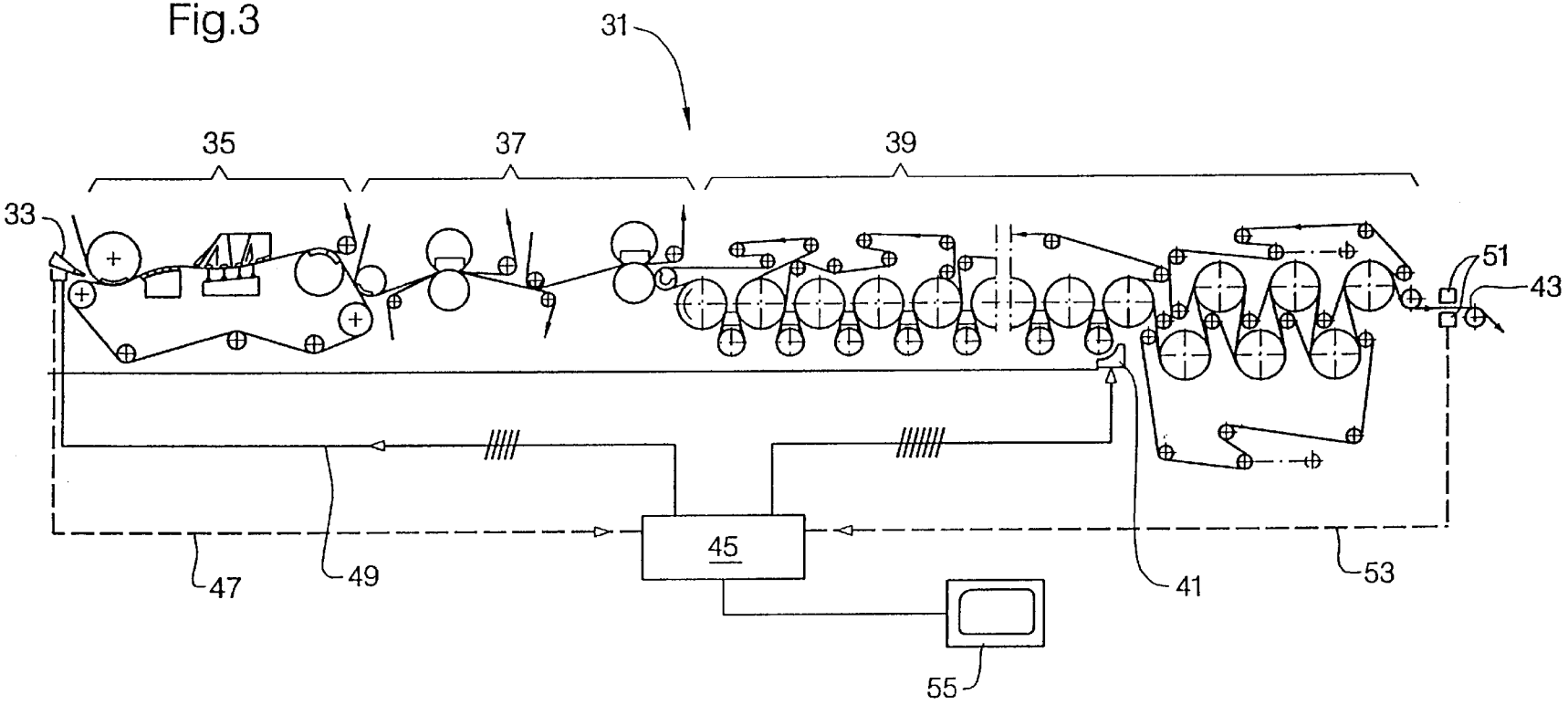
FIG. 3 is a diagram of the construction of a papermaking machine.

FIG. 3 shows a papermaking machine 31 having a headbox 33 which is comparable to the headbox 5 shown in FIG. 1. Furthermore, the papermaking machine 31 has a wire section 35 also known as former, a press section 37 and a drier section 39. The latter is provided with at least one steam blow box 41 which can be regulated zonewise, by means of which the cross section of the web of material 43, for instance the dry-content cross section can be influenced.

The papermaking machine 31 furthermore has an arithmetic unit 45 which is comparable to the arithmetic unit 11 shown in FIG. 1. The headbox 33 is connected with the arithmetic unit 45 by signal lines 47 and 49 via which, on the one hand, for instance, the actual position of different actuators of the headbox 33 can be detected and which, on the other hand, serve to forward control signals to the actuators.

The papermaking machine 31 is furthermore also provided with a measuring device 51 which corresponds to the measuring device 13 shown in FIG. 1 and which gives off measurement signals to the arithmetic unit 45 via a signal line 53. This unit can be provided with a monitor 55 on which both measurement signals and control signals can be displayed.

From FIG. 3, it is clear that, by means of the measuring device 51, cross sections of the web of material 43 can be detected. A particularly important field of use of the invention is the so-called basis-weight cross section control by means of which a mass distribution of the web of material referred to the surface which is as uniform as possible is to be established. If, therefore, deviations in the desired basis weight of the web of material, and therefore deviations in the basis-weight cross section, are noted by means of the measuring device 51, then certain actuators of the headbox 33 can be so controlled via the arithmetic unit 45 that the desired thickness of the web of material or the desired basis weight is established. Therefore, local influencing of the amount of fiber given off via the headbox 33 is possible.

Similarly, by means of the arithmetic unit 45, it is possible so to control the steam blow box 41 that individual zones of the web of material 43 are heated to a greater or lesser extent. In this way a given moisture cross section of the web of material 43 can be established and thus, in the final analysis, the transverse-shrinkage cross section also specifically controlled.

In view of the foregoing, it is clear that, by means of the invention described here, a cross section of a web of material can be controlled in specific fashion since the local properties of the web of material can be influenced by a targeted adjustment of different actuators, whether actuators in the headbox or in a steam blow box.

The especially important use of the invention will again be discussed with reference to FIG. 4, namely the basis-weight cross-section control for the setting of a predetermined basis-weight cross section of a web of material at a headbox.

Figure 4:
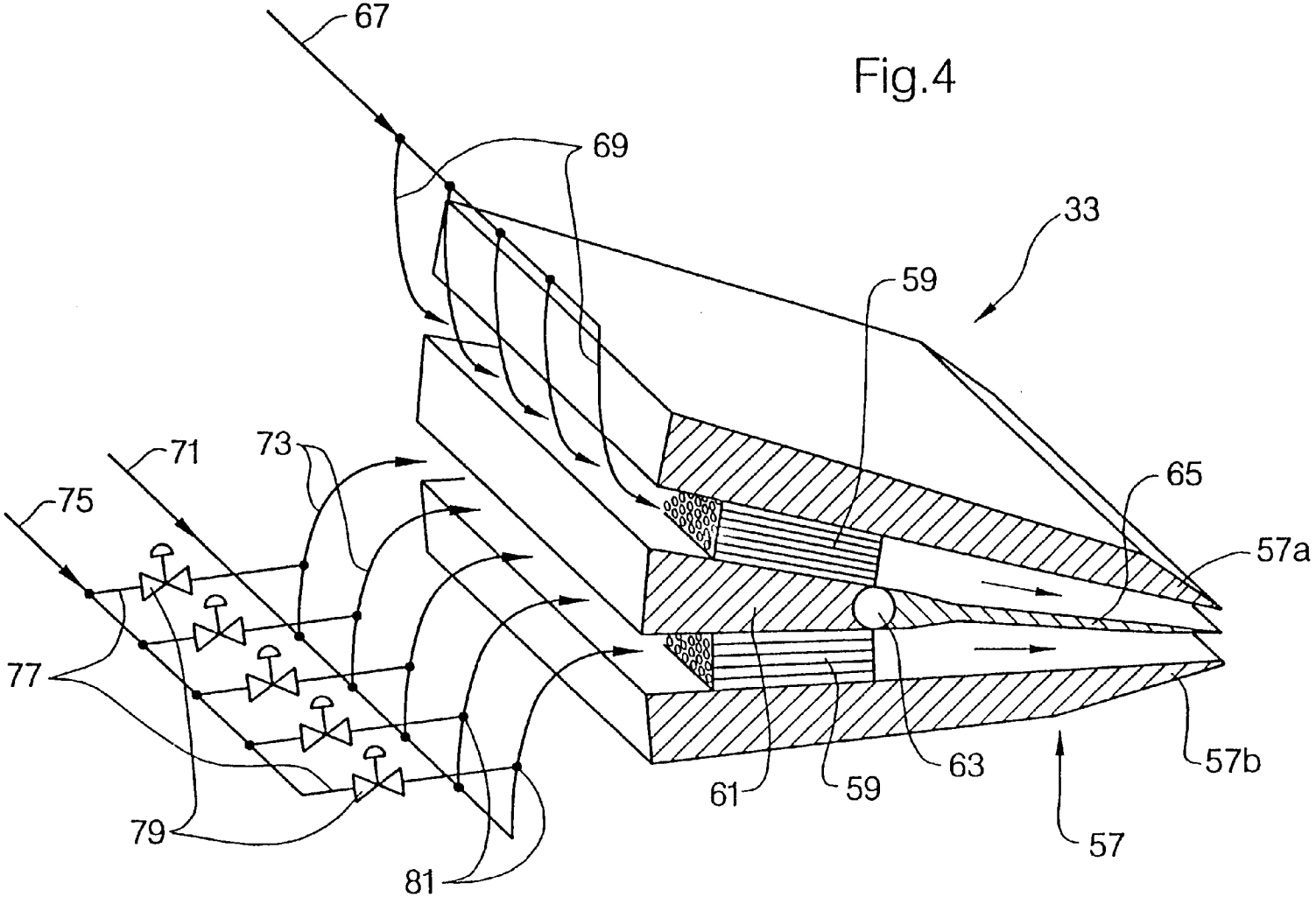
FIG. 4 shows a two-layer headbox for producing a fiber web with a system of conduits shown diagrammatically.

FIG. 4 shows, merely by way of example, a two-layer headbox 33 together with a diagrammatically shown system of conduits for the feeding of different fiber slurries.

The headbox 33 comprises a nozzle 57 which is limited, in known manner, by two flow guide walls 57*a* and 57*b* which extend over the width of the papermaking machine 31. The flow guide walls 37*a*, 37*b* are connected in each case by a known turbulence generator 59 with a middle stationary partition 61. At the outlet end of the partition 61, a blade 65 is again swingably fastened by means of a joint 63. Differing from this, the blade can also be fastened rigidly to the partition 61.

A first main stream of pulp which consists of a first type of pulp passes, via a transverse distributing line 67 and a number of sectional feed lines 69 branching off from it, to one of the two turbulence generators 59.

Differing from the showing of FIG. 4, an actuator developed as volume controller can be provided in each of the sectional feed lines 69.

A second main stream of pulp, consisting of a different type of pulp, passes, via a transverse distributing line 71 and a number of sectional feed lines 73 branching off from it, to the other turbulence generator. In order that the basis-weight cross section of the web of paper or material to be produced can, if necessary, be corrected, a third transverse distributing line 75 is provided via which a so-called secondary stream of pulp is fed. It consists, for instance of water of dilution or of a second type of pulp but with a different, preferably lower, pulp density. From the transverse distributing line 75, a plurality of sectional feed lines 77 branch off, each provided with an actuator developed as control valve 79.

Each of the feed lines 77 thus conducts a controllable sectional secondary stream of pulp to a mixing place 81 where it is mixed with one of the sectional main pulp streams.

In the case of a three-layer headbox, the system of conduits 71 to 77 with the control valve 79 and the mixing cells 81 is preferably associated with the middle layer.

Differing from the showing in FIG. 4, the following could, in addition, also be provided: Further feed lines for individually controllable sectional secondary streams of pulp could debouch into the sectional feed lines 69 for the first main stream of pulp.

From the basic diagram shown in FIG. 4, it is already clear that the actuators can be arranged relatively close to each other. While in traditional types of headbox the baffle displacement of which is effected in particular by setting spindles, the influence of the displacement of a setting spindle on the basis-weight cross section corresponds to more than four times the distance between actuators, the adjustment of an actuator which influences the secondary stream of pulp on the basis-weight cross section acts approximately in the region of two and one half times the spacing between actuators.

By means of the invention, it is possible, despite the slight distance between the actuators, upon a local deviation of the cross section of the web of material, for precisely that actuator by means of which the desired cross section can be set to respond. In this connection, due to the relatively high density of the actuators, a substantially improved quality of paper can be obtained.

From the description, it is clear, as a whole, that the method for determining the effect of a actuator adjustment can be carried out in simple manner in that, in this connection, the process of manufacturing a web of material is in no way disturbed and, in particular, no disadvantages for the properties of the web resulting solely from the measurement occur. There is merely required the prediction of the expected effect on basis of detection values. By the comparison of the theoretically predicted effect with measured web-property cross-section values, an improvement in the detection values can be effected until the prediction agrees substantially with the measured values.

The method is suitable for the prediction, on the one hand, of the place of the effect of an actuator adjustment but also, on the other hand, of the course of the web properties in the vicinity of the place of the effect, and therefore with respect to the form of the effect. The predictions as to the form of the effect, and therefore as to the width of the effect at the place of the effect and with regard to the amplitude of the changes of the properties of the web of material at the place of the effect, are improved stepwise more and more by comparison with measured values. In this way, also, a superimposing on the effect of a actuator adjustment of the effects of adjacent actuator adjustments can also be predicted. It is found, namely, that the extent of the effect of the adjustment of an actuator is frequently so wide that it extends over several actuators.

By means of the method for determining the effect of the actuator adjustments it is possible, in accordance with what has been stated above, exactly to determine both a transverse-shrinkage cross section of a web of material and the sidewise course of the web of material within the papermaking machine. The transverse-shrinkage cross section is, on the one hand, of interest as an important quality parameter of the web produced and, on the other hand, it also permits conclusions as to the function of the production machine.

It is found that the effect can be initially approximately predicted on basis of detection values and that upon the displacement of several spindles and the determination of the effect of the displacements, the prediction as to the effect can be adapted so that both a transverse-shrinkage cross section and a sidewise course of the web can be detected.

Particularly, due to the fact that after each adjustment of an actuator, the effect is predetermined and checked by measurement, a large number of measured values are obtained, so that the detection values can be optimally adapted. The large number of determination of the effects can best be obtained by an automatic carrying out of the method, so that finally also an on-line determination of the effects is possible.

From what has been stated above, the purposes of the transverse shrinkage measurement described become clear. First of all there is to be made possible a control of the cross section by means of which the associating of the actuator positions with the measurement-member positions is established so that the actuators to be addressed for an optimal influencing of the cross section can be located.

Furthermore a technological evaluation of the process is to be possible, for instance in the drier section a uniform drying over the width of the web, or in the wet section a uniform orientation of the fibers and a uniform longitudinal to transverse tear-strength ratio over the width of the web or the like.

Upon the technological evaluation of the process, the exact shape of the curve of the transverse-shrinkage cross section is important. Upon the carrying out of a cross section control, the error at each actuator position must be less than 0.5 times the distance between the actuators in order for automatic control to be possible. With an error which is less than 0.2 times the distance between actuators, a meaningful control can be realized.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for determining an effect of an adjustment of actuators used in the manufacture of a web of material, which adjusters are partially arranged over a width of the web and influence the properties of the web of material, which method includes the steps of:

(a) adjusting at least one actuator;

(b) making a prediction as to the effect of the adjustment of the at least one actuator derived from detection values on the behavior of at least one cross section property of the web upon adjustment of the at least one cross section;

(c) inputting said prediction into a dynamic model;

(d) measuring the at least one cross section property of the web before and after adjustment of the at least one actuator in step (a);

(e) comparing the prediction of the effect of the actuator adjustment made in step (b) with the measured effect in step (c);

(f) if the results of step (d) do not indicate a predetermined degree of agreement, modifying the detection values to obtain such predetermined degree of agreement between the predicted and the measured effects; and (g) repeating steps (a) to (f) inputting into the repeated step (b) the detection values modified in the previous step (f).

2. A method according to claim 1, wherein in step (b) a prediction is made as to the place of the effect of adjustment of the at least one actuator.

3. A method according to claim 1, wherein in step (b) a prediction is made as to a geometrical shape of the effect.

4. A method according to claim 3, wherein in step (b) a prediction is made as to the extent of the effect at the corresponding place of the effect.

5. A method according to claim 3, wherein in step (b) a prediction is made as to the amplitude of the change in the at least one cross section property of the web of material at the corresponding place of the effect.

6. A method according to claim 1, wherein the at least one cross section property is the transverse-shrinkage.

7. A method according to claim 1, wherein the at least one cross section property is the sidewise course of the web of material.

8. A method according to claim 1, wherein in step (a) a plurality of actuators are adjusted to adjust the at least one cross section property.

9. A method according to claim 8, wherein in step (a) the plurality of actuators are adjusted in a manner necessary for continuous setting of the at least one cross section property.

10. A method according to claim 1, wherein in step (a) a plurality of actuators are adjusted to automatically control the at least one cross section property.

11. A method according to claim 10, wherein steps (b), (d) and (e) are carried out automatically by a control computer.

12. A method according to claim 1, wherein steps (a)–(e) are carried out on-line.

13. A method according to claim 1, wherein the at least one cross section property is at least one of basis-weight, moisture content and density of the web of material.

14. A method according to claim 1, wherein the detection values on the behavior of the at least one cross section property are obtained first of all on the basis of general statements as to the behavior of the at least one property.

15. A method according to claim 1, wherein steps (a)–(e) are repeated until the predetermined degree of agreement is obtained.

16. A method according to claim 15, wherein the detection values are modified stepwise, in which connection, first of all a general, simple statement with regard to the behavior of the at least one cross section property of material is used in step (b) and finally a prediction is made which reproduces as accurately as possible the actual at least one cross section property of the web of material.

17. A method according to claim 16, wherein an averaging of the results of a large number of predictions is used in steps (b) and (d).

18. A method according to claim 16, wherein a filter algorithm of the results of a large number of predictions is used in steps (b) and (d).

19. A method according to claim 16, wherein the degree of agreement between measurement and prediction is determined in step (b) by calculation.

20. A method according to claim 16, wherein the degree of agreement between measurement and prediction is determined in step (b) by correlation calculus.

21. A method according to claim 16, wherein the degree of agreement between measurement and prediction is determined in step (b) by mean-square deviation.

* * * * *